US010847329B1

(12) United States Patent
Lin

(10) Patent No.: US 10,847,329 B1
(45) Date of Patent: Nov. 24, 2020

(54) BUTTON DEVICE

(71) Applicant: SUNREX TECHNOLOGY CORP., Taichung (TW)

(72) Inventor: Shih-Pin Lin, Taichung (TW)

(73) Assignee: SUNREX TECHNOLOGY CORP., Taichung (TW)

( * ) Notice: Subject to any disclaimer, the term of this patent is extended or adjusted under 35 U.S.C. 154(b) by 0 days.

(21) Appl. No.: 16/787,091

(22) Filed: Feb. 11, 2020

(30) Foreign Application Priority Data

Nov. 4, 2019 (TW) ..... 108214573 U

(51) Int. Cl.
*H01H 13/14* (2006.01)
*H01H 13/04* (2006.01)
*H01H 13/20* (2006.01)

(52) U.S. Cl.
CPC ..... *H01H 13/14* (2013.01); *H01H 13/04* (2013.01); *H01H 13/20* (2013.01); *H01H 2233/07* (2013.01)

(58) Field of Classification Search
CPC .... H01H 13/7065; H01H 13/14; H01H 13/04; H01H 13/20; H01H 2233/07
See application file for complete search history.

(56) References Cited

U.S. PATENT DOCUMENTS

2015/0114813 A1* 4/2015 Chen ..... G06F 3/0202 200/5 A
2018/0025857 A1* 1/2018 Yen ..... H01H 3/125 200/344

* cited by examiner

*Primary Examiner* — Nguyen Tran
*Assistant Examiner* — Iman Malakooti
(74) *Attorney, Agent, or Firm* — Burris Law, PLLC

(57) ABSTRACT

A button device includes a base extending in a longitudinal direction, a sensor module mounted to the base, a keycap disposed above the sensor module, two scissor switch modules, and a pushbutton module. The sensor module has a first sensing member and two second sensing members disposed at two opposite sides of the first sensing member in the longitudinal direction. The pushbutton module is operable to switch between a released state, where the pushbutton module is not in direct contact with the first sensing member such that each of the scissor switch modules would not be indirect contact with corresponding second sensing member, and a depressed state, where the pushbutton module comes in direct contact with the first sensing member.

6 Claims, 7 Drawing Sheets

BUTTON DEVICE

CROSS-REFERENCE TO RELATED APPLICATION

This application claims priority of Taiwanese Patent Application No. 108214573, filed on Nov. 4, 2019.

FIELD

The disclosure relates to a button device, and more particularly to a button device for a keyboard.

BACKGROUND

A conventional button device includes a base, three spaced-apart sensing members mounted to the base, a keycap disposed above the sensing members, and three switch modules respectively corresponding in position to the sensing members. Each of the switch modules has an elastic member that is supported between the keycap and the base, and a protrusion that extends from the elastic member toward a respective one of the sensing members.

When the keycap has been pressed, the keycap would push against the elastic members of the switch modules, such that the protrusions thereof would abut against respective sensing members to signal stress has been exerted onto the keycap. As the switch modules are spaced apart along the keycap, the switch modules ensure that stress applied to different portions of the keycap would be properly detected.

However, as the elasticity of each of the elastic members that are connected to the same keycap may vary from one another due to assembly error, some portions of the keycap may be easier or harder to press in comparison to the other portions, which may feel rather uncomfortable.

SUMMARY

Therefore, an object of the disclosure is to provide a button device that can alleviate the drawback of the prior art.

According to the disclosure, the button device for a keyboard includes abase extending in a longitudinal direction, a sensor module, a keycap disposed above the sensor module, two scissor switch modules, and a pushbutton module. The sensor module includes a first sensing member that is mounted to a top surface of the base and that is for sensing stress exerted thereto, and two second sensing members that are respectively disposed at two opposite sides of the first sensing member in the longitudinal direction. The scissor switch modules are spaced apart in the longitudinal direction, are mounted to the base, and are respectively corresponding in position to the second sensing members. Each of the scissor switch modules includes a first scissor frame that is rotatably connected to the base, and a second scissor frame that is rotatably connected to the first scissor frame to define an axis of rotation therebetween, that is rotatably connected to the keycap, and that has a resilient member disposed above a respective one of the second sensing members. The pushbutton module is resiliently connected between the base and the keycap, and corresponding in position to the first sensing member.

Each of the scissor switch modules is operable to switch between a released state, where the resilient member is not in direct contact with the corresponding second sensing member, and a depressed state, where the first and second scissor frames are pushed by the keycap, such that the resilient member comes in direct contact with the corresponding second sensing member.

The pushbutton module is operable to switch between a released state, where the pushbutton module is not in direct contact with the first sensing member such that each of the scissor switch modules remains in its respective released state, and a depressed state, where the pushbutton module comes in direct contact with the first sensing member.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
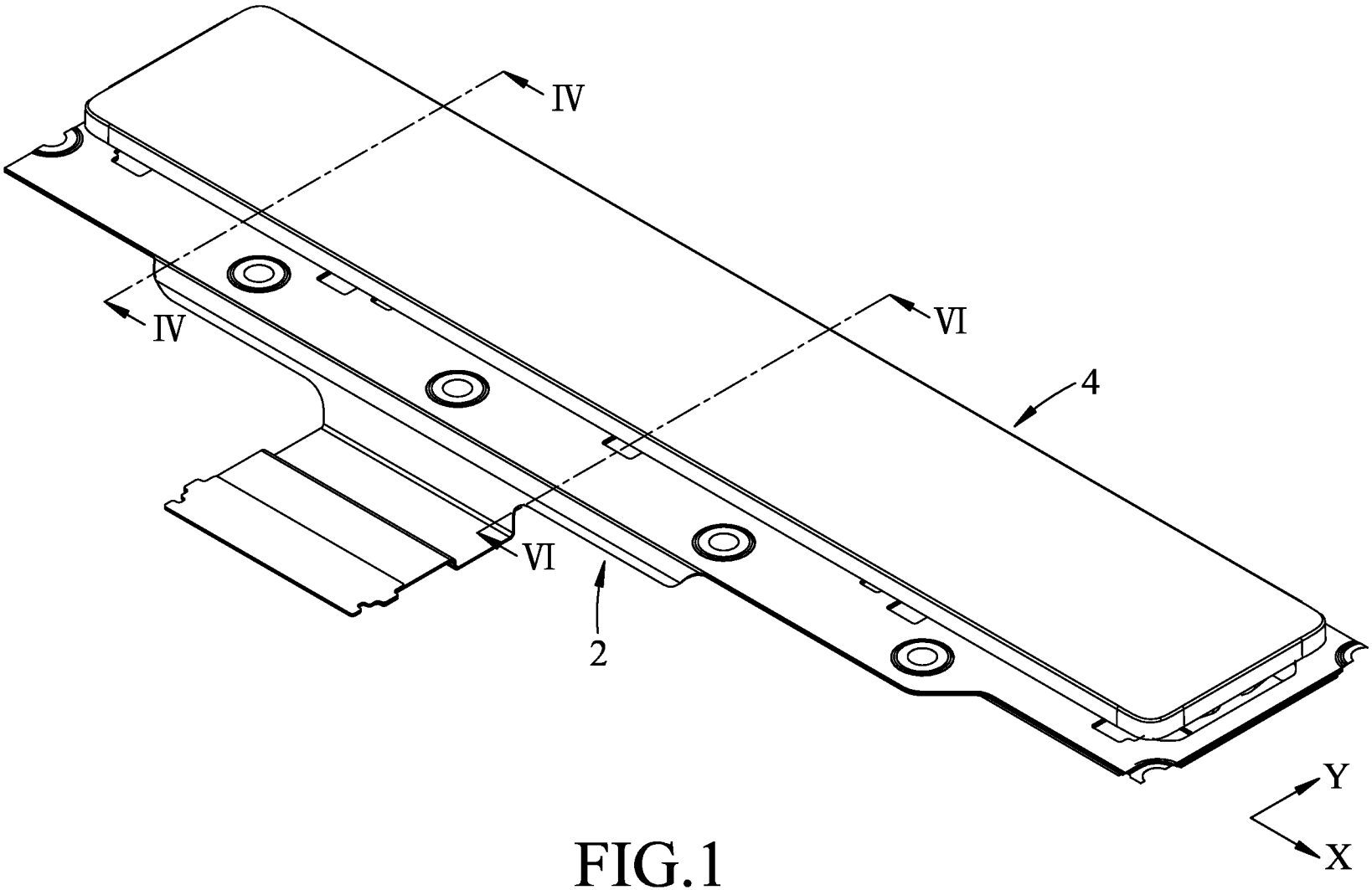
FIG. 1 is a perspective view of an embodiment of a button device according to the disclosure.
Figure 2:
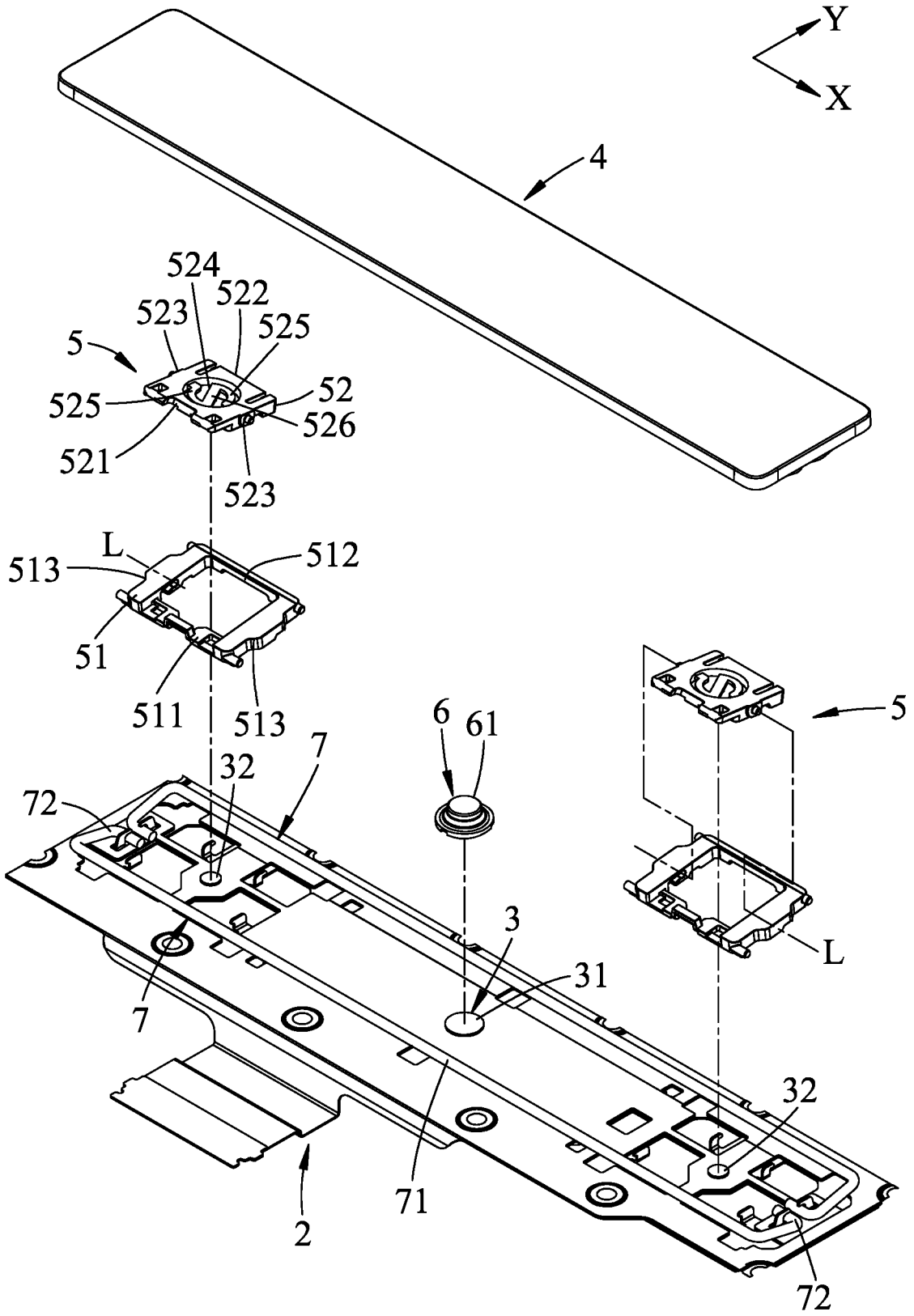
FIG. 2 is an exploded perspective view of the embodiment.
Figure 3:
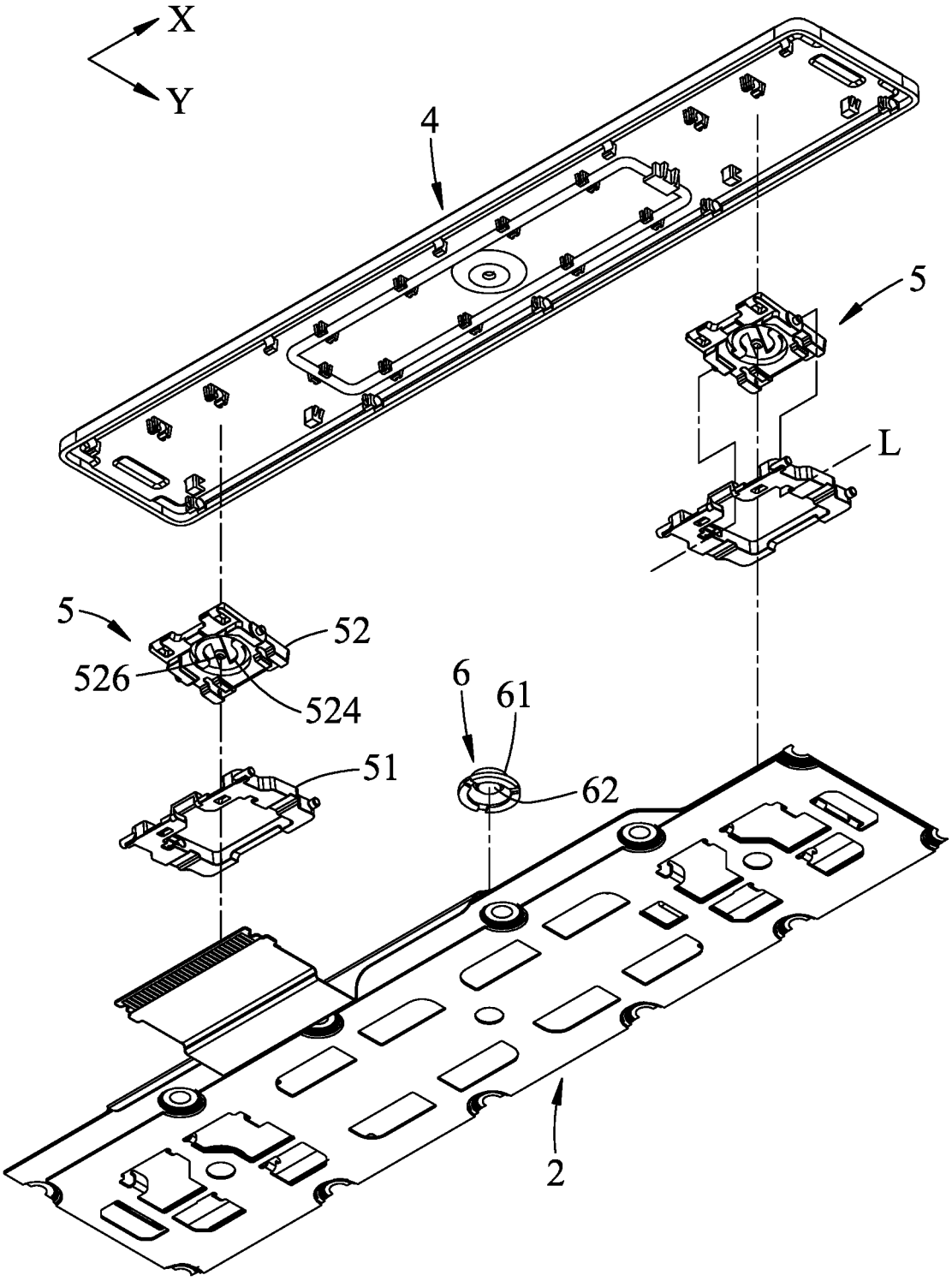
FIG. 3 is another exploded perspective view of the embodiment.

Referring to FIGS. 1 to 3, an embodiment of a button device according to the disclosure is for a keyboard, and includes a base 2 that extends in a longitudinal direction (X), a sensor module 3, a keycap 4 that is disposed above the sensor module 3, two scissor switch modules 5 that are mounted to the base 2, a pushbutton module 6 that is resiliently connected between the base 2 and the keycap 4, and two support rods 7.

The sensor module 3 includes a first sensing member 31 that is mounted to a top surface of the base 2 and that is for sensing stress exerted thereto, and two second sensing members 32 that are mounted to the top surface of the base 2 and that are respectively disposed at two opposite sides of the first sensing member 31 in the longitudinal direction (X). In this embodiment, the first and second sensing members 31, 32 are piezoresistive pressure sensors, but can be capacitive pressure sensors or other types of pressure sensors in other embodiments.

The scissor switch modules 5 are spaced apart in the longitudinal direction (X), and respectively correspond in position to the second sensing members 32. Each of the scissor switch modules 5 includes a first scissor frame 51 that is rotatably connected to the base 2, and a second scissor frame 52 that is rotatably connected to the first scissor frame 51 to define an axis of rotation (L) therebetween. In this embodiment, the axis of rotation (L) of each of the scissor switch modules 5 extends in the longitudinal direction (X).

The first scissor frame 51 of each of the scissor switch modules 5 has a first bottom portion 511 that is rotatably mounted to the base 2, a first top portion 512 that is proximate to the keycap 4, and two spaced-apart first side portions 513 that interconnect said the first bottom portion 511 and the first top portion 512.

The second scissor frame 52 of each of the scissor switch modules 5 has a second top portion 521 that is rotatably mounted to the keycap 4, a second bottom portion 522 that is slidably movable along the base 2, a resilient member 524 that is diposed above and extends toward a respective one of the second sensing members 32, and two spaced-apart second side portions 523 that interconnect the second top portion 521 and the second bottom portion 522, that are respectively and rotatably connected to the first side portions 513 of the first scissor frame 51, and that are respectively connected to two opposite sides of the resilient member 524.

Specifically, the resilient member 524 has two arc sections 525 that are symmetrical with respect to a vertical axis and that are respectively connected to the second side portions 523, and an extending section 526 that interconnects the arc sections 525 and that extends toward the respective one of the second sensing members 32.

The pushbutton module 6 corresponds in position to the first sensing member 31, and has a dome-shaped cover 61 that resiliently interconnects the keycap 4 and the base 2 and that covers the first sensing member 31, and a protrusion 62 that protrudes from an inner surface of the cover 61 and that extends toward the first sensing member 31.

The support rods 7 are spaced apart in a lateral direction (Y) perpendicular to the longitudinal direction (X). Each of the support rods 7 has a support portion 71 that is rotatably mounted to the keycap 4, and two pivot portions 72 that respectively extend from two opposite ends of the support portion 71 and that are rotatably mounted to the base 2.

The pivoting mechanism among the base 2, the keycap 4, the first and second scissor frames 51, 52, and the support rods 7 is commonly known in keyboard assembling, and is therefore not in details thereafter.

Figure 4:
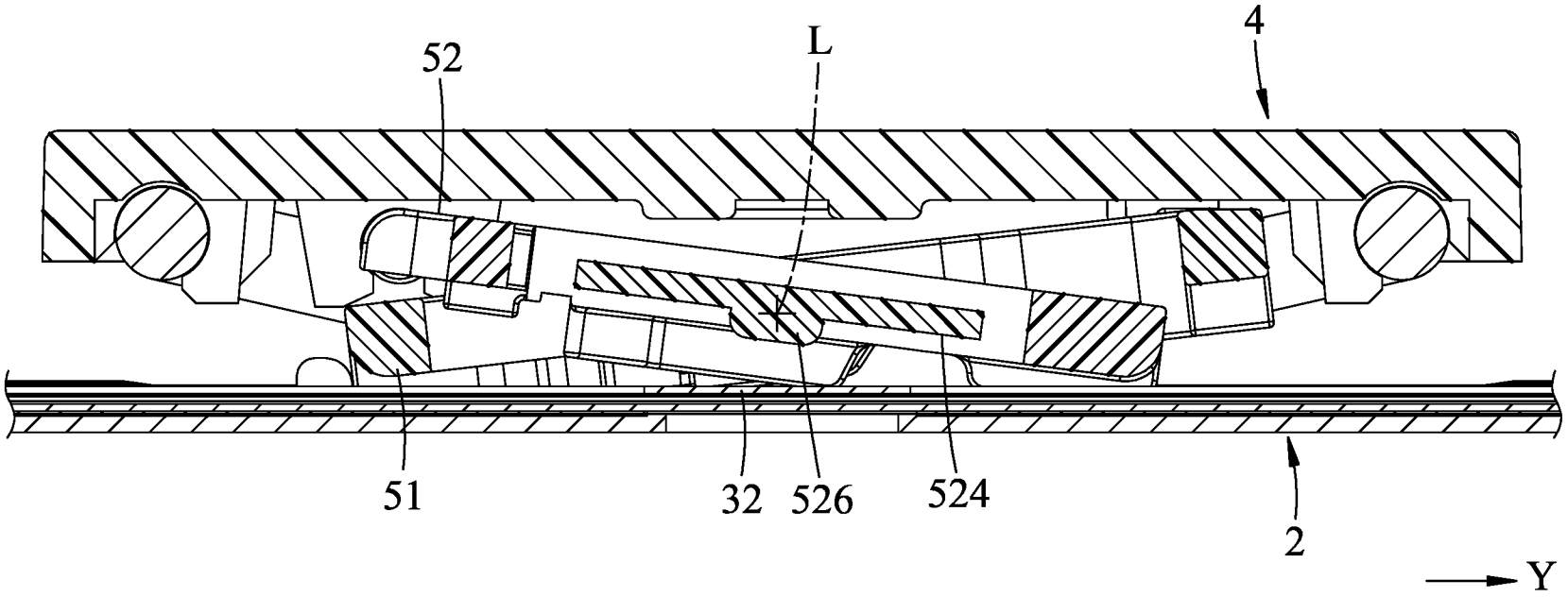
FIG. 4 is a fragmentary sectional view taken along line IV-IV in FIG. 1, illustrating a scissor switch module in a released state.
Figure 5:
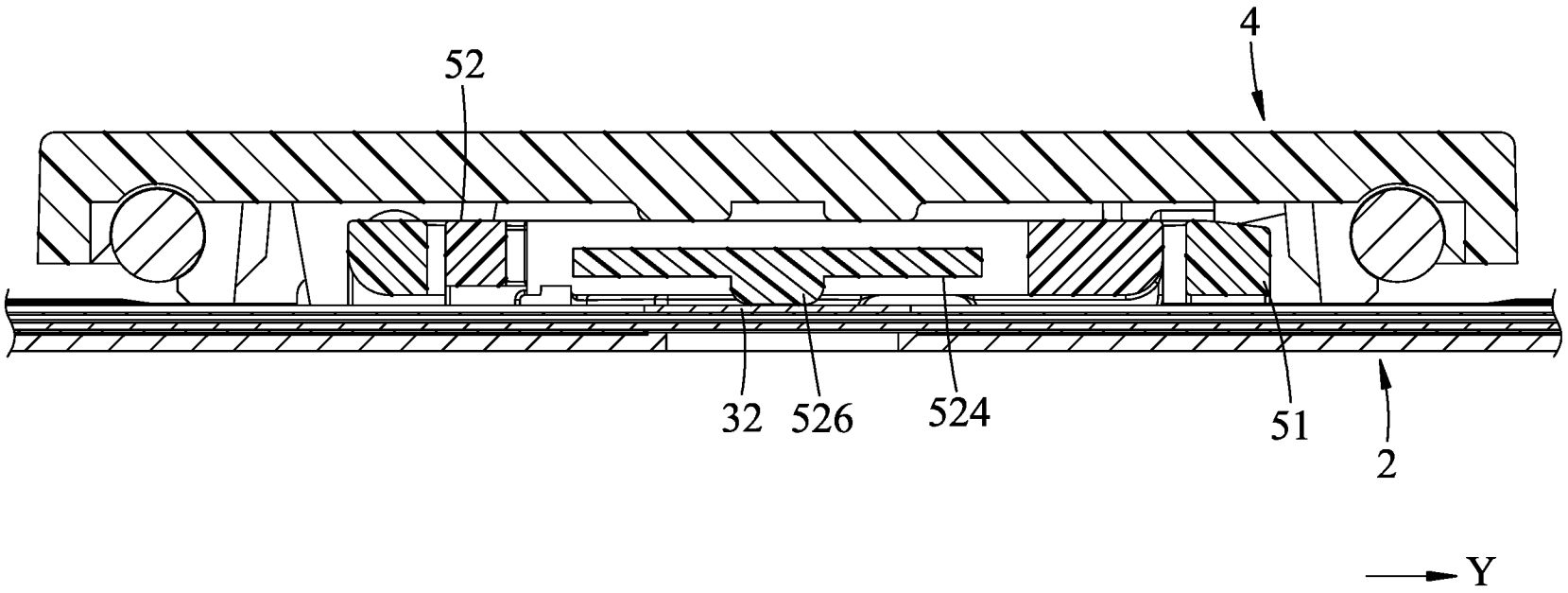
FIG. 5 is a view similar to FIG. 4, illustrating the scissor switch module in a depressed state.

Referring to FIGS. 2, 4 and 5, each of the scissor switch modules 5 is operable to switch between a released state (see FIG. 4), where the resilient member 524 is not in direct contact with the corresponding second sensing member 32, and a depressed state (see FIG. 5), where the first and second scissor frames 51, 52 are pushed by the keycap 4, such that the extending section 526 of the resilient member 524 comes in direct contact with the corresponding second sensing member 32, and such that the corresponding second sensing member 32 detects pressure thereon.

Figure 6:
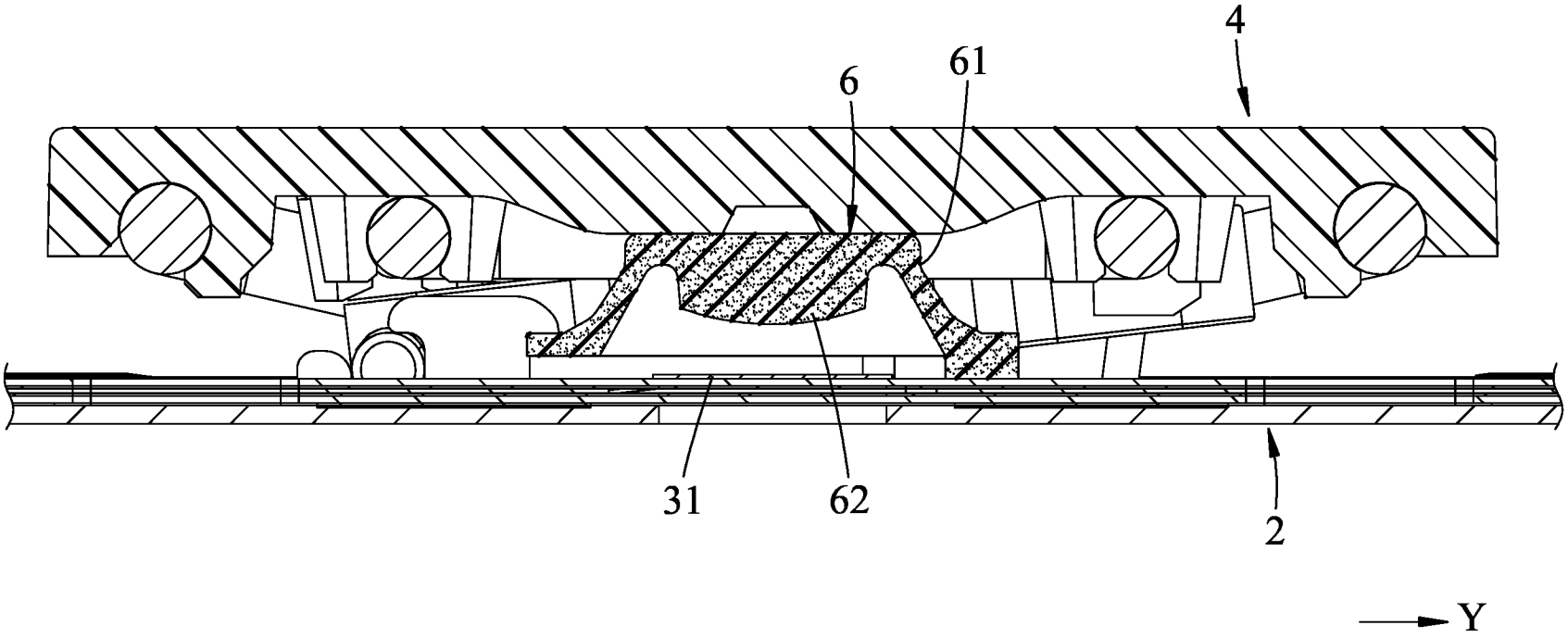
FIG. 6 is a fragmentary sectional view taken along line VI-VI in FIG. 1, illustrating a pushbutton module in a released state.
Figure 7:
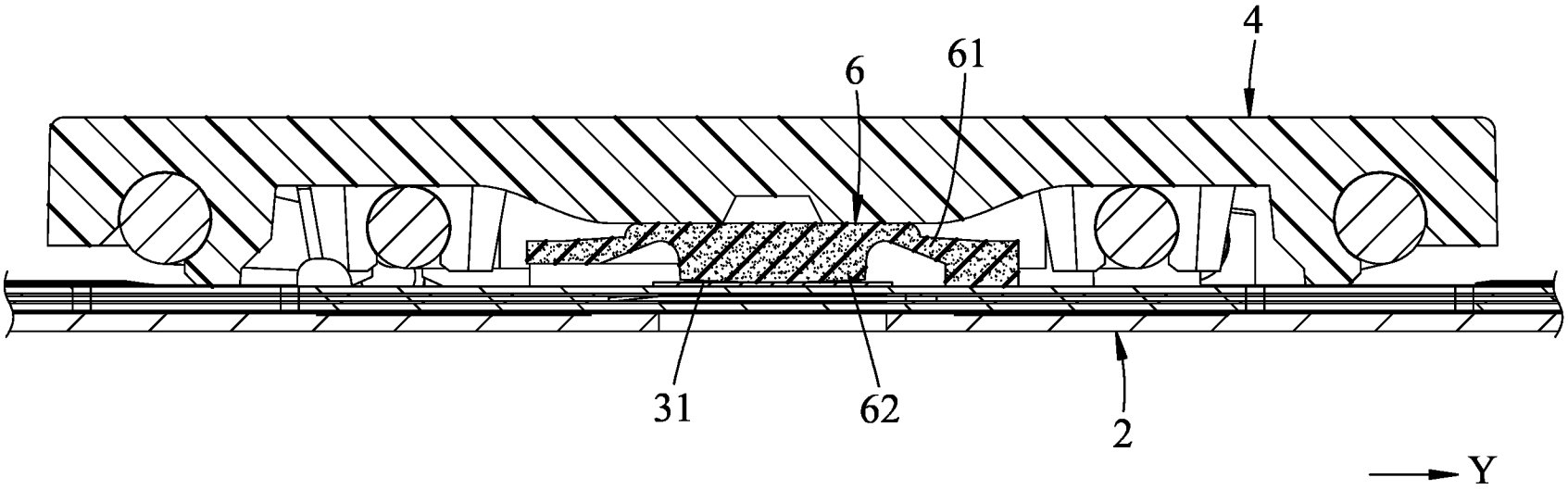
FIG. 7 is a view similar to FIG. 6, illustrating the pushbutton module in a depressed state.

Referring to FIGS. 2, 6 and 7, the pushbutton module 6 is operable to switch between a released state (see FIG. 6), where the pushbutton module 6 is not in direct contact with the first sensing member 31 such that each of the scissor switch modules remains in its respective released state, and a depressed state (see FIG. 7), where the cover 61 of the pushbutton module 6 is deformed and the protrusion 62 comes in direct contact with the first sensing member 31, such that the first sensing member 31 detects pressure thereon.

When a user presses a center portion of the keycap 4, the keycap 4 pushes against the pushbutton module 6 so that the pushbutton module 6 is switched to the depressed state, such that the first sensing member 31 detects pressure thereon. When the user no longer presses the keycap 4, the cover 61 resiliently pushes the keycap 4, such that the pushbutton module 6 is switched to the released state.

When a user presses a side portion of the keycap 4 instead, the keycap 4 abuts against a corresponding one of the scissor switch modules 5 so that the corresponding one of the scissor switch modules 5 is switched to the depressed state and the the cover 61 of the pushbutton module 6 is deformed, such that the corresponding one of the second sensing members 32 detects pressure thereon. At this time, the other one of the scissor switch modules 5 remains in the released state. When the user no longer presses the keycap 4, the cover 61 resiliently pushes the keycap 4, such that the scissor switch module 5 is switched back to the released state.

Overall, since the keycap 4 is considered "being pressed" when any of the first and second sensing members 31, 32 detects pressures thereon, this embodiment ensures that the keystroke of the user is properly detected even if the user does not press the central portion of the keycap 4. In addition, as the resilient force to push the keycap 4 back to its original position is done solely by the cover 61, and the scissor switch modules 5 are only meant to interconnect different elements, the issues of having different elastic members interfering with one another (e.g. exerting varying degree of elastic forces) during use or during assembly would not arise in this embodiment. In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A button device for a keyboard, said button device comprising:

a base extending in a longitudinal direction;

a sensor module including a first sensing member that is mounted to a top surface of said base and that is for sensing stress exerted thereto, and two second sensing members that are respectively disposed at two opposite sides of said first sensing member in the longitudinal direction;

a keycap disposed above said sensor module;

two scissor switch modules spaced apart in the longitudinal direction, mounted to said base, and respectively corresponding in position to said second sensing members, each of said scissor switch modules including a first scissor frame that is rotatably connected to said base, and a second scissor frame that is rotatably connected to said first scissor frame to define an axis of rotation therebetween, that is rotatably connected to said keycap, and that has a resilient member disposed above a respective one of said second sensing members; and a pushbutton module resiliently connected between said base and said keycap, and corresponding in position to said first sensing member;

wherein, each of said scissor switch modules is operable to switch between a released state, where said resilient member is not in direct contact with said corresponding second sensing member, and a depressed state, where said first and second scissor frames are pushed by said keycap, such that said resilient member comes in direct contact with said corresponding second sensing member; and wherein, said pushbutton module is operable to switch between a released state, where said pushbutton module is not in direct contact with said first sensing member such that each of said scissor switch modules remains in its respective released state, and a depressed state, where said pushbutton module comes in direct contact with said first sensing member.

2. The button device as claimed in claim 1, wherein:

said first scissor frame of each of said scissor switch modules has a first bottom portion that is rotatably mounted to said base, a first top portion that is proximate to said keycap, and two spaced-apart first side portions that interconnect said first bottom portion and said first top portion; and said second scissor frame of each of said scissor switch modules has a second top portion that is rotatably mounted to said keycap, a second bottom portion that is slidably movable along said base, and two spaced-apart second side portions that interconnect said second top portion and said second bottom portion, that are respectively and rotatably connected to said first side portions of said first scissor frame of said scissor switch module, and that are respectively connected to two opposite sides of said resilient member.

3. The button device as claimed in claim 2, wherein:

said resilient member of said second scissor frame of each of said scissor switch modules has two arc sections that are symmetrical and that are respectively connected to said second side portions, and an extending section that interconnects said arc sections and that extends toward the respective one of said second sensing members.

4. The button device as claimed in claim 1, wherein:

said pushbutton module has a dome-shaped cover that resiliently interconnects said keycap and said base and that covers said first sensing member, and a protrusion that protrudes from an inner surface of said cover and that extends toward said first sensing member.

5. The button device as claimed in claim 1, further comprising two support rods that are spaced apart in a lateral direction perpendicular to the longitudinal direction, each of said support rods having a support portion that is rotatably mounted to said keycap, and two pivot portions that respectively extend from two opposite ends of said support portion and that are rotatably mounted to said base.

6. The button device as claimed in claim 1, wherein the axis of rotation of each of said scissor switch modules extends in the longitudinal direction.

* * * * *